United States Patent [19]

Beckers

[11] Patent Number: 5,027,987

[45] Date of Patent: Jul. 2, 1991

[54] ROTARY VALVE CLOSURE FOR A CONTAINER HAVING A BOTTOM DISCHARGE OPENING

[75] Inventor: Dieter Beckers, Neunkirchen-Seelscheid, Fed. Rep. of Germany

[73] Assignee: Martin & Pagenstecher GmbH, Köln-Mühlheim, Fed. Rep. of Germany

[21] Appl. No.: 455,637

[22] Filed: Dec. 22, 1989

[30] Foreign Application Priority Data

Dec. 23, 1988 [DE] Fed. Rep. of Germany ..... 3843456
Dec. 24, 1988 [DE] Fed. Rep. of Germany ..... 3843865

[51] Int. Cl.[5] ..... B22D 41/08
[52] U.S. Cl. ..... 222/598; 222/591
[58] Field of Search ..... 222/591, 597, 598, 599, 222/555

[56] References Cited

U.S. PATENT DOCUMENTS 3,710,992 1/1973 Hoffmann ..... 222/555
3,760,992 9/1973 Bieri ..... 222/555

FOREIGN PATENT DOCUMENTS 1910247 9/1970 Fed. Rep. of Germany ..... 222/598
2198979 6/1988 United Kingdom ..... 222/598

*Primary Examiner*—S. Kastler
*Attorney, Agent, or Firm*—Michael J. Striker

[57] ABSTRACT

A rotary slide valve closure for metal melt containers having a bottom discharge wherein the rotary slide valve closure has a fixed refractory top block and a rotary refractory discharge block sealingly tight engaging the fixed refractory top block and including a discharge flow duct positionable coaxial with the flow duct of the fixed refractory top block. An assembly plate is attached to the bottom of a metal melt container. Joint means pivotally supports a slide valve casing on the assembly plate. The rotary slide valve closure also includes an annular entraining casing pivotally arranged in the slide valve casing for supporting the rotary refractory discharge block. The rotary discharge block has a substantially flat sealing and a sliding surface engaging the fixed refractory top block and a spherical portion extending below the sealing and sliding surface. The entraining casing has a spherical inner surface engaging the spherical portion of the rotary refractory discharge block.

6 Claims, 3 Drawing Sheets

ROTARY VALVE CLOSURE FOR A CONTAINER HAVING A BOTTOM DISCHARGE OPENING

BACKGROUND OF THE INVENTION

The invention relates to a rotary slide valve closure for metal melt containers having a bottom discharge opening, comprising a fixed refractory top block formed with a flow duct, and a rotary refractory discharge block formed with a flow duct and and which is in a sealing-tight relationship against the top block. The axis of rotation of the discharge block forms an acute angle with the vertical central axis of the flow duct, and the place of intersection of the axis of rotation with the central axis of the flow duct being is located in the cross-sectional plane of the discharge opening of the flow duct in the discharge block.

In the customary rotary slide valve closure with a vertical axis of rotation, when the slide valve plate is adjusted in the direction of heavier or lower throttling, the discharge opening and, therefore, the position of the emerging stream are displaced laterally together with the slide valve plate. In contrast, when the slide valve plate rotates around its axis in the closure as in the invention, the opening of the flow channel situated on the inside is guided in an arc of a circle and completely or partially opens or closes the flow channel, while the discharge opening maintains its position, so that the emerging stream of melt does not shift. This is advantageous in all casting operations in which the pouring stream must not shift, for example, when casting into a continuous chill mould or when introducing the stream of metal into the mould pouring gate during production of shaped castings.

A rotary slide valve of this kind is known from German AS 20 43 588, but it has disadvantages. For example, the perforated plate and slide valve plate, constructed in the form of frustoconical members, are disposed in a slide valve casing comprising an upper and lower part interconnected via a screwed connection. However, screwed connections are disadvantageous for heavy-duty steelworks operations. The axial position of the slide valve casing is adjusted in relation to the opening in the container bottom by intermediate rings. However, such an adjustment is unpractical for steelworks operations and can lead to inaccuracies of assembly. Moreover, the perforated plate and the slide valve plate are rigidly disposed on the slide valve casing, so that it is probably difficult to achieve an even bearing of the sealing and sliding surface of the perforated plate or the slide valve plate, more particularly since refractory members may have dimensional tolerances due to manufacture.

Other disadvantages are the construction of the rotary slide valve from many complicated parts, its large overall height, the difficulty of assembling and demounting the whole slide valve closure at the discharge opening of the vessel, and the complicated interchange of used refractory members. These disadvantages have probably contributed towards such rotary slide valve closures not being widely adopted, although steelworks and foundries require a slide valve closure in which the emerging stream of melt does not shift.

SUMMARY OF THE INVENTION

It is an object of the invention so to construct a rotary slide valve closure of the kind specified that it is free from the disadvantages described. More particularly, the rotary slide valve closure is uncomplicated in construction and has a reduced overall height. Furthermore, the rotary slide valve closure can be assembled and disassembled without complications at the discharge opening of the vessel. Used refractory members can be very simply interchanged and new refractory members incorporated, while a uniform positioning of sealing surfaces of a perforated plate and a slide valve plate is achieved.

According to the invention a casing is provided which can be pivoted via an arrangement of joints on an assembly plate attached to the bottom of the container and which can be closed via a closure member, to press the sealing and sliding surface of the discharge block against the sealing and sliding surface of the fixed top block. A drivable, annular entraining casing pivotably mounted in the casing, receives the frustoconical discharge block. The peripheral surface of the discharge block is spherical in its upper portion below its sealing surface, while the inner surface of the entraining casing, which supports the discharge block, is constructed correspondingly concave.

A worm gear is provided to rotate the entraining casing and the discharge block which is supported therein for joint rotation therewith.

The joint arrangement has a pivoting axis for opening and closing the casing and which is also the axis of the worm gear with a worm. A toothed rim engaging with the worm is disposed in the lower portion of the entraining casing.

The entraining casing has in the lower portion a crowned external contour and engages against a correspondingly trough-shaped slide ring on the inside wall of the slide valve casing.

The closure member takes the form of a screwthreaded rod having a ball end movably retained in an opening in the assembly plate. Disposed on the screwthreaded rod is a casing which has a spring pack and an adjusting nut and engages in a matching recess in the slide valve casing.

According to a further feature of the invention, disposed above the assembly plate is a supporting ring with bearing surfaces for receiving the refractory top block. The top block being is locked by a pin which engages in a bore in the top block.

The present invention both as to its construction so to its mode of operation, together with additional objects and advantages thereof, will be best understood from the following detailed description of the preferred embodiment with reference to the appended drawings.

DETAILED DESCRIPTION OF THE INVENTION

Figure 1:
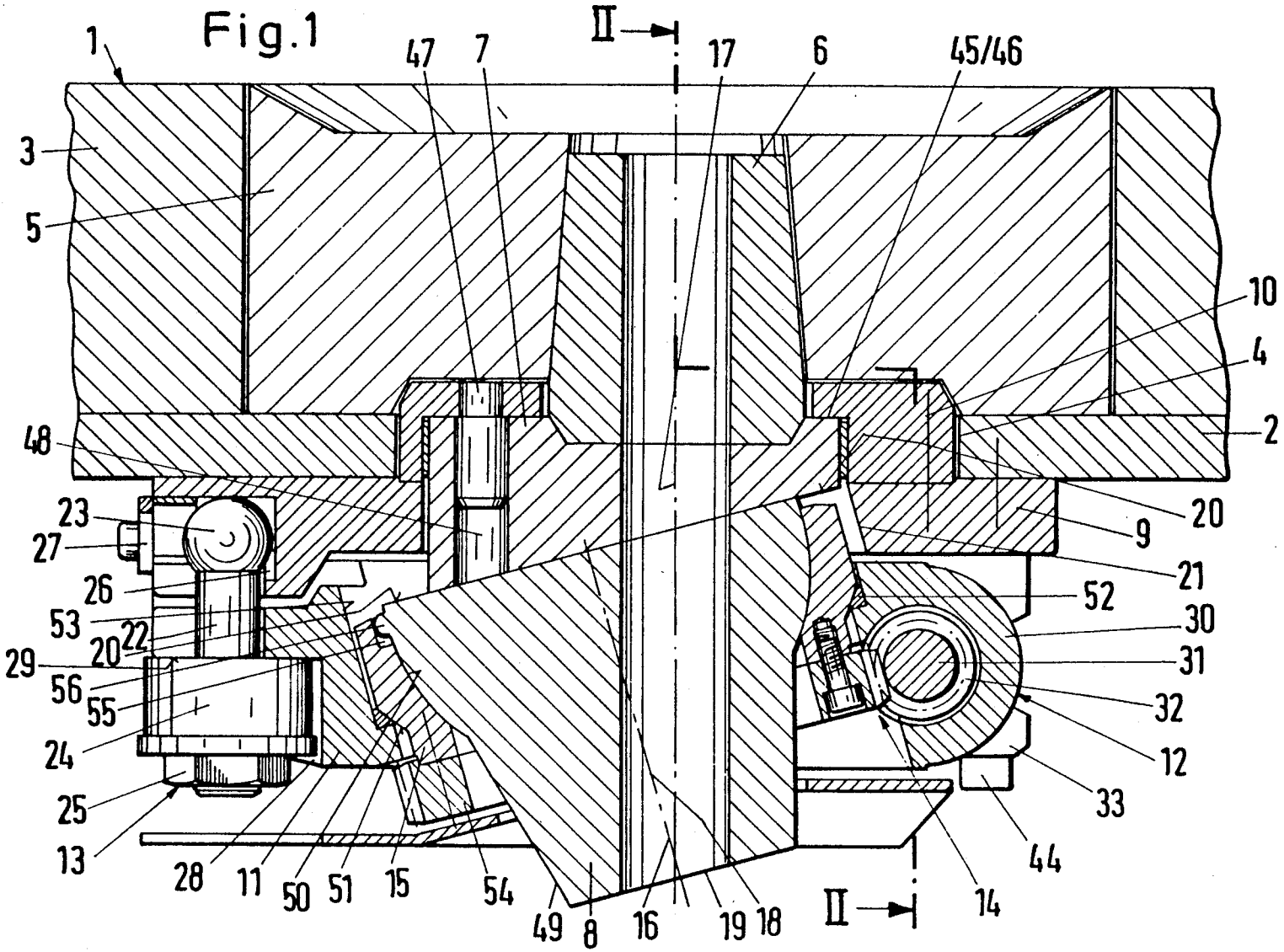
FIG. 1 is a cross-sectional view of a rotary slide valve according to the invention disposed on the bottom portion of a vessel.
Figure 3:
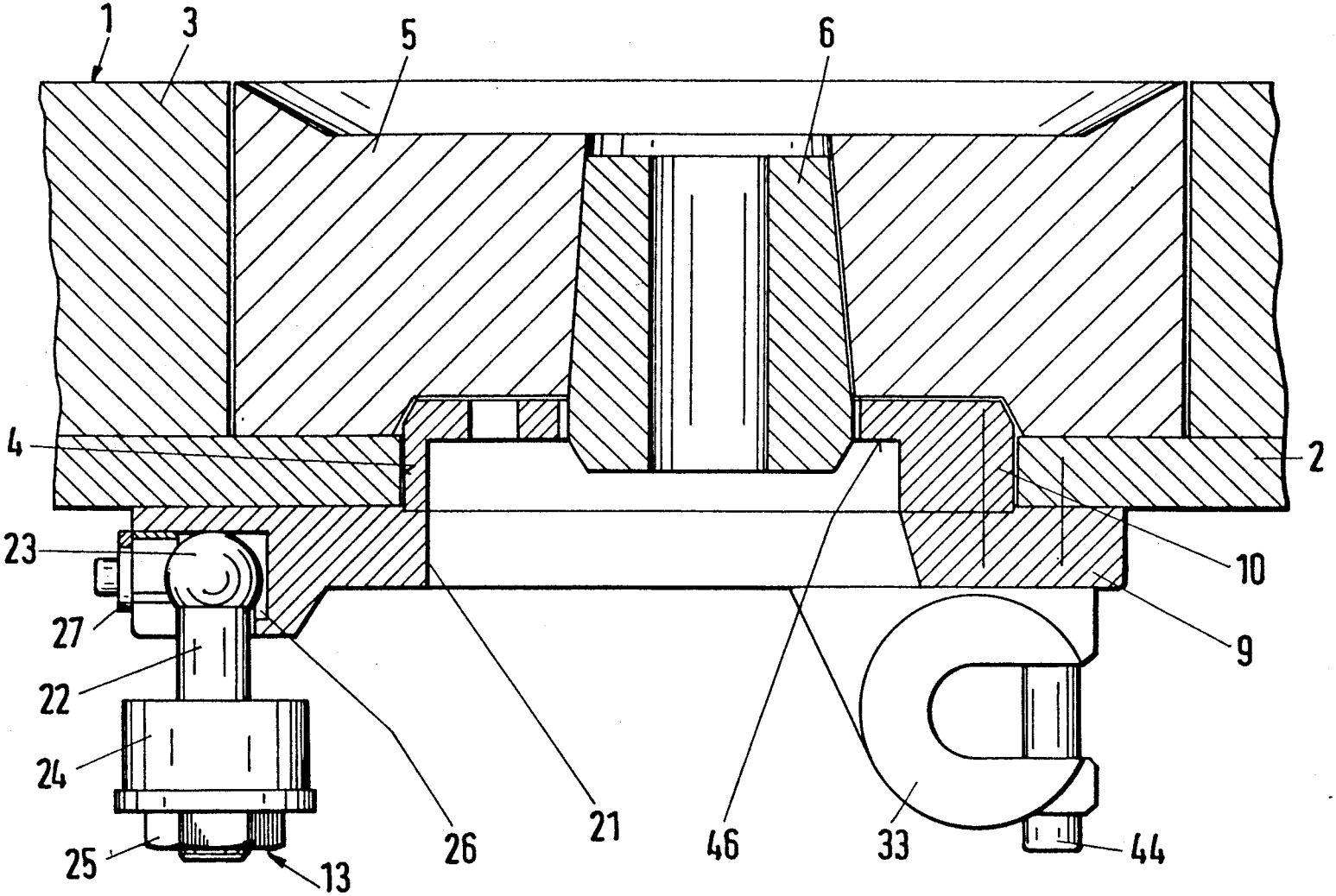
FIG. 3 is a cross-sectional view corresponding to that shown in FIG. 1, without the rotary slide valve casing with the associated refractory members.

As shown by FIGS. 1 and 3, the rotary slide valve closure according to the invention is disposed on the bottom of a vessel 1 which can be, for example, a casting ladle, such as used in steelworks and foundries, or an intermediate vessel, such as used in continuous casting. The bottom of the vessel 1 comprises an outer metal jacket 2 having a refractory inner lining 3, which includes a refractory bottom block 5 with a refractory perforated block 6 in the zone of a flow opening 4 in the metal jacket 2.

As shown more particularly in FIG. 1, the main components of the rotary slide valve closure are a top block 7 which is retained fixed, a rotatable discharge block 8, an assembly plate 9 with a supporting ring 10, a slide valve casing 11 which is pivotably mounted on the assembly plate 9 and has associated arrangements of joints 12, closure 13, and an entraining casing 15 moved by a worm gear 14 and supporting the refractory discharge block 8.

As shown in FIG. 1, the axis of rotation 16 of the discharge block 8 is inclined to the vertical. The sealing and sliding surfaces 20 of the top block 7 and the discharge block 8 are accordingly inclined to the horizontal.

As shown in FIG. 1, the axis of rotation 16 of the discharge block 8 and the central axis of the flow channels 17 and 18 of the top block 7 and the discharge block 8 intersect one another in the plane of the outer discharge opening 19 of the flow channel 18 of the discharge block 8 and diverge at an acute angle in the direction to the inside of the container. When the discharge block 8 rotates around the axis of rotation 16, the opening of the flow channel 18 of the discharge block 8 moves relative the sliding and sealing surface 20 and is guided in the arc of a circle so that the flow channel 18 is partially opened or closed, while the discharge opening 19 of the flow channel 18 maintains its position, so that the emerging stream of melt does not shift.

The assembly plate 9, which is formed with an opening 21, is attached to the metal jacket 2 below the opening 4, as shown more particularly in FIG. 3. On its upper side, the assembly plate 9 carries the supporting ring 10 which is attached thereto, extends into the opening 4 in the metal jacket 2, and adjoins the refractory bottom block 5.

The closure 13 comprises a screwthreaded rod 22 having a ball end 23, and a casing 24 having a spring pack, and associated adjusting nut 25. The ball end 23 is movably retained by a closure plate 27 in a correspondingly constructed opening 26 at the edge of the assembly plate 9.

As FIG. 1 shows, the slide valve casing 11 is annular. On one side, it is formed with a recess 28 having a bearing surface 29 for the closure 13, and on the other side, it has a tubular portion 30 receiving a pivot 31 of the joint arrangement 12 which at the same time forms the pivot of the worm gear 14 with the worm 32.

Figure 2:
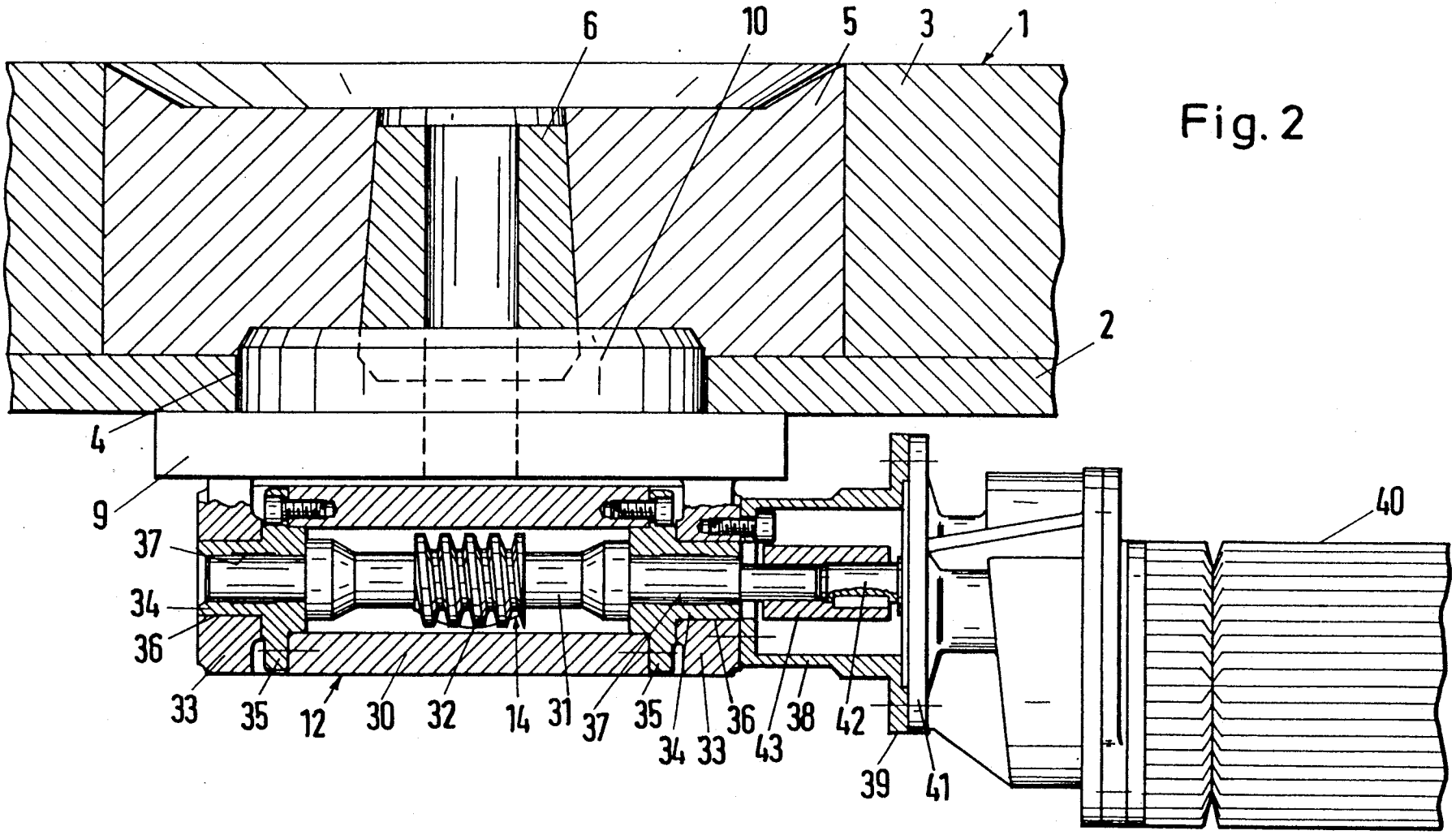
FIG. 2 is a cross-sectional view taken along the line II—II in FIG. 1.

As FIG. 2 shows in detail, the pivot 31 is mounted in two lateral bearing lugs 33 of the assembly plate 9. To enable the pivot 31 to perform its double function as a pivoting axis for the joint arrangement 12 and as a pivot for the worm gear 14, disposed on the pivot 31 are two tubular bearings 34 connected by screws via flanges 35, to the tubular portion 30 of the slide valve casing 11. Each of the bearings has an external bearing surface 36 for the pivoting movement in the bearing lugs 33, and an inner bearing surface 37 for the rotary movement of the pivot 31 as the driving spindle of the worm gear.

Attached to one bearing lug 33 is a connecting member 38 having a flange 39. A drive motor 40 with a step-down transmission is attached via a counter flange 41 to the flange 39. The end of the pivot 31 extending into the connecting member 38, is connected via a coupling member 43 to the shaft end of the driving shaft 42 of the drive motor 40. To ensure assembly, as shown in FIG. 3, the bearing lugs 33 and the connecting member 38 are open at the side. A helical locking device locks the bearings 34 in the bearing lugs 33.

FIG. 1 shows how the refractory top block 7, which has a binding ring, is disposed in the supporting ring 10. Its surface 44 in the direction of the interior of the vessel bears against the bearing surface 43 of the supporting ring 10. A pin 47 retained in the supporting ring 10 and engaging in a bore 48 in the top block 7 retains the top block 7, fixed.

The refractory discharge block 8 is disposed in the entraining casing 15, which is annular in construction. Its peripheral surface 49 is spherical in the upper portion below the sealing and sliding surface 20. The inner surface 50 of the entraining casing 15, which bears the discharge block 8, is correspondingly hollow and spherical. This ensures that when the slide valve casing 11 is closed, if any deviations in dimensions due to manufacture occur, the discharge block 8 can adjust itself in the spherical guide, and its sliding and sealing surface 20 engages the corresponding surface of the top block 7 sealingly-tight.

The entraining casing 15 is pivotably mounted in the slide valve casing 11. To this end, the entraining casing 15 has an outer crowned portion 51. A corresponding crowned slide ring 52 disposed on the inside wall 53 of the slide valve casing 11 acts as a sliding bearing for the rotary movement of the entraining casing 15.

The entraining casing 15 is provided with a toothed rim 54. The worm 32 on the pivot 31 of the worm gear 14 meshes with the toothed rim 54 causing rotation of the entraining causing 15.

FIG. 1 also shows how the entraining casing 15 has on the inside and in the upper portion recesses 55 into which projections 56 on the discharge block 8 engage. This prevents the discharge block 8 from sliding in the entraining casing 15 when such block rotates.

For closing the slide valve casing 11, the screwthreaded rod 22 is pushed with the casing 24 disposed thereon into the recess 28 in the casing 11. The casing 24 with the spring pack disposed therein is supported against the bearing surface 29. An operator tightens the associated adjusting screw 25 on the screwthreaded rod 22, using a moment spanner, until the adjusted force of contact pressure has been reached between the sliding and sealing surfaces 20 of the top block 7 and the discharge block 8.

An engineer in the art can gather from this description of the embodiment the advantages of the rotary slide valve closure according to the invention, attention being drawn more particularly to the following advantages:

1. The rotary slide valve closure according to the invention has an uncomplicated construction with a reduced overall height. Because of the frequent lack of space found with the intermediate vessel of a continuous casting installation the closure is particularly suitable for such vessels: since the emerging stream of melt does not shift, even narrow continuous casting chill moulds can be reliably filled. The same thing applies to the filling of casting mould pouring gates, if the closure is used for ladles in foundries.

2. The rotary sliding valve closure can be very simply assembled and disassembled on the particular vessel.

3. Used refractory members can be quickly and very simply interchanged, and new members quickly and very simply incorporated.

4. Due to the adjustability of the rotatable discharge block, it is reliably and evenly supported against the fixed top block, even if the refractory members have dimensional divergences caused by their manufacture.

It will be understood that each of the elements described above, or two or more together, may also find a useful application in other types of structures differing from the types described above.

While the invention has been illustrated and described as embodied in a rotary valve closure for a container having a bottom discharge opening, it is not intended to be limited to the details, shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

1. A rotary slide valve closure for metal melt containers having a bottom discharge, said rotary slide valve closure comprising a fixed refractory top block having a flow duct; a rotary refractory discharge block sealingly tight engaging said fixed refractory top block, said discharge block being provided with a discharge flow duct positionable coaxial with said flow duct of said fixed refractory top block, said discharge flow duct having a discharge opening, and said discharge block having an axis of rotation extending at an acute angle to a central axis of said discharge flow duct and intersecting the central axis at a point lying in a cross-sectional plane of said discharge opening; an assembly plate attached to the bottom of a metal melt container; a slide valve casing; joint means for pivotally supporting said slide valve casing on said assembly plate; closure means for closing said slide valve casing; and a drivable annular entraining casing pivotally arranged in said slide valve casing for supporting said rotary refractory discharge block, said rotary discharge block having a sealing and a sliding surface engaging said fixed refractory top block and a spherical portion extending below said sealing and sliding surface, said entraining casing having a spherical inner surface engaging said spherical portion of said rotary refractory discharge block and said spherical inner surface of said entraining casing and said spherical portion of said top block being so structured that said sliding and sealing surface engages sealingly tight a corresponding surface of said refractory top block.

2. A rotary slide valve closure as set forth in claim 1, further comprising gear means for rotating said entraining casing, said rotary refractory discharge block being supported by said entraining casing for joint rotation therewith.

3. A rotary slide valve closure as set forth in claim 2, wherein said gear means comprises a worm gear having a worm portion and an axis, said joint means including a pivot axis coinciding with the axis of the worm gear, and a toothed rim arranged in a lower portion of said entraining casing and engaging said worm.

4. A rotary slide valve closure as set forth in claim 1, wherein said slide valve casing has an inside wall, said rotary slide valve closure further comprising a trough-shaped slide ring engaging said inside wall of said slide valve casing, said entraining casing having in a lower portion a crowned external contour thereof bearing against said trough-shaped slide ring.

5. A rotary slide valve closure as set forth in claim 1, wherein said assembly plate has an opening, said closure means including a threaded rod having a ball end received in said opening in said assembly plate, a casing having an adjusting nut, received on said threaded rod and mounted in a matching recess in said slide valve casing.

6. A rotary slide valve closure as set forth in claim 1, further comprising a supporting ring arranged above said assembly plate and having a bearing surface for supporting said refractory top block; and a pin for fixing said refractory top block, said refractory top block having a bore for receiving said pin.

* * * * *